US007883398B2

(12) United States Patent
Buljan et al.

(10) Patent No.: US 7,883,398 B2
(45) Date of Patent: Feb. 8, 2011

(54) ABRASIVE TOOL

(75) Inventors: Sergej-Tomislav Buljan, Acton, MA (US); Srinivasan Ramanath, Holden, MA (US); Donald Brodeur, Worcester, MA (US); Robert F. Corcoran, Oakham, MA (US)

(73) Assignee: Saint-Gobain Abrasives, Inc., Worcester, MA (US)

( * ) Notice: Subject to any disclaimer, the term of this patent is extended or adjusted under 35 U.S.C. 154(b) by 0 days.

(21) Appl. No.: 11/203,456

(22) Filed: Aug. 11, 2005

(65) Prior Publication Data

US 2007/0037501 A1 Feb. 15, 2007

(51) Int. Cl.
*B24B 23/00* (2006.01)

(52) U.S. Cl. ..... 451/449; 451/548

(58) Field of Classification Search ..... 451/548, 451/541, 449, 547; 125/15
See application file for complete search history.

(56) References Cited

U.S. PATENT DOCUMENTS

| | | | | |
|---|---|---|---|---|
| 4,082,640 | A | | 4/1978 | Haack |
| 4,381,227 | A | | 4/1983 | Narcus |
| 4,547,998 | A | * | 10/1985 | Kajiyama ..... 451/541 |
| 4,555,315 | A | | 11/1985 | Barbieri et al. |
| 4,817,341 | A | | 4/1989 | Umeda |
| 4,882,878 | A | | 11/1989 | Benner |
| 4,925,457 | A | | 5/1990 | deKok et al. |
| 4,925,457 | A | | 5/1990 | deKok et al. |
| 5,049,165 | A | | 9/1991 | Tselesin |
| 5,313,742 | A | | 5/1994 | Corcoran, Jr. et al. |
| 5,620,489 | A | | 4/1997 | Tselesin |
| 5,817,204 | A | | 10/1998 | Tselesin |
| 5,947,805 | A | | 9/1999 | Van Osenbruggen |
| 5,980,678 | A | | 11/1999 | Tselesin |
| 6,007,415 | A | | 12/1999 | Van Osenbruggen |
| 6,056,794 | A | | 5/2000 | Stoetzel et al. |
| 6,077,156 | A | | 6/2000 | Amin et al. |
| 6,159,089 | A | | 12/2000 | Amin et al. |
| 6,200,208 | B1 | | 3/2001 | Andrews et al. |
| 6,273,082 | B1 | | 8/2001 | Tselesin |
| 6,312,325 | B1 | | 11/2001 | Van Osenbruggen |
| 6,394,888 | B1 | | 5/2002 | Matsumoto et al. |
| 6,451,076 | B1 | | 9/2002 | Nevoret et al. |
| 6,615,816 | B2 | | 9/2003 | Ogata |
| 6,685,755 | B2 | | 2/2004 | Ramanath et al. |
| 6,685,756 | B2 | | 2/2004 | Nevoret et al. |
| 6,702,650 | B2 | | 3/2004 | Adefris |
| 2002/0151265 | A1 | | 10/2002 | Adefris et al. |
| 2003/0153247 | A1 | | 8/2003 | Tricard et al. |
| 2006/0048454 | A1 | | 3/2006 | Welygan et al. |

FOREIGN PATENT DOCUMENTS

| | | | | |
|---|---|---|---|---|
| JP | 56089479 | | 7/1981 | |
| JP | 62-193775 | * | 8/1987 | ..... 125/15 |
| WO | WO 02/28802 A2 | | 4/2002 | |
| WO | WO 02/45908 A1 | | 6/2002 | |
| WO | WO 03/011782 | | 2/2003 | |

* cited by examiner

*Primary Examiner*—Robert Rose

(57) ABSTRACT

An abrasive tool, suitable for cutting, slotting, grinding and polishing hard materials, such as ceramics, metals, and composites thereof, and methods for making same. The tool includes a plurality of pores positioned in an abrasive region adjacent an outer circumference of the disk. The pores have any predetermined shape, size and position relative to one another.

26 Claims, 1 Drawing Sheet

ABRASIVE TOOL

BACKGROUND OF INVENTION

1. Field of Invention

The present invention relates to abrasive tools and process for making same, and more particularly to abrasive wheels suitable for grinding and polishing hard materials, such as metals, ceramics, and composites thereof.

2. Discussion of Related Art

Abrasive tools are commonly used in precision surface grinding or polishing of ceramic, metal, and or composite components. In many grinding operations which utilize abrasive wheels, the thinness, rigidity or stiffness, and surface finish of the cut are important factors. Examples of grinding operations include the dicing, slicing, scribing, slotting, and squaring of silicon wafers and so-called pucks made of alumina-titanium carbide composite for the electronics industry in general, and for the computer industry in particular. As is well known, silicon wafers are processed for integrated circuits, while alumina-titanium carbide pucks are utilized to fabricate flying thin film heads for writing (recording) and reading (playing back) information magnetically stored in computers.

Fine surface finish requirements on the cut surface are commonly achieved by using finer abrasive grits to obtain mirror-like surfaces. Increasing abrasive concentration in the abrasive tool increases stiffness and durability. However, as the concentration of finer abrasives increases in the tool, the number of cutting points significantly increases leading to the generation of high grinding forces. An increase in grinding forces increases heat and tool instability resulting in poor work surface finish. Abrasive tools having a high concentration of fine abrasive grits also typically quickly load with workpiece debris or swarf, which limits permissible cut rates.

Conventional porous abrasive tools, having pores positioned throughout the entirety of the tool, are known. Conventional porous metal composite grinding wheels are commonly formed by processing the metal composite below its necessary time, temperature, and pressure. Conventional porous grinding wheels are also formed by sintering a less well packed metal composite, or by adding hollow glass and ceramic spheres to the composite.

U.S. Pat. No. 6,394,888 to Matsumoto et al., discloses abrasive tools containing high concentrations of hollow filler materials in a resin bond suitable for polishing and backgrinding hard materials.

U.S. Pat. No. 6,685,755 to Ramanath, et al., discloses an abrasive wheel prepared by blending a mixture of abrasive grain, bond material and dispersoid particles. The powder mixture is then pressed into an abrasive laden composite and thermally processed. After cooling, the composite is immersed into a solvent, which dissolves substantially all of the dispersoid particles, leaving a highly porous, bonded abrasive article.

U.S. Pat. No. 6,702,650 to Adefris, discloses a porous abrasive article having a plurality of ceramic abrasive composites bonded together by a binder matrix to form a shaped or irregular abrasive composite used to grind glass and other workpiece surfaces to a mirror finish.

Conventional porous abrasive tools provide a reduced number of cutting points, but may also reduce the overall strength of the tool, and specifically may reduce the strength near an inner diameter of the tool, where tangential stresses are greatest. In addition, controlling the size and shape of porosity in conventional porous tools is difficult, and if hollow spheres are used, it is difficult to prevent crushing the spheres during manufacture. A need remains to provide abrasive tools for cutting and grinding ceramics and other semiconductor materials to mirror-like finishes, having commercially acceptable strength, material removal rates, and wear rates.

SUMMARY OF INVENTION

The invention is directed to an abrasive tool, suitable for cutting, slotting, grinding and polishing hard materials, such as ceramics, metal, and composites thereof, and methods for making same.

One embodiment is directed to an abrasive disk comprising an abrasive, a continuous region adjacent an inner circumference of the disk, and a porous region adjacent an outer circumference of the disk, wherein about 50 volume % to about 80 volume % of the porous region comprises metal bonded abrasive grain.

Another embodiment is directed to a method of forming an abrasive disk comprising providing a disk comprising about 50 volume % to about 80 volume % of a metal bonded abrasive grain in an outer circumferential region of the disk, and forming a plurality of pore in the outer circumferential region.

Another embodiment is directed to an abrasive disk comprising a body containing about 50 volume % to about 80 volume % of an abrasive, and a plurality of etched pores extending through the body from a first surface of the body to a second surface of the body.

Another embodiment is directed to a method of grinding a silicon or alumina-titanium carbide material comprising rotating an abrasive disk having a solid region adjacent an inner circumference of the disk and a plurality of pore adjacent an outer circumference of the disk, and contacting the outer circumference of the rotating abrasive disk with the material to provide a ground material Other advantages, novel features, and objects of the invention will become apparent from the following detailed description of non-limiting embodiments of the invention when considered in conjunction with the accompanying drawings

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
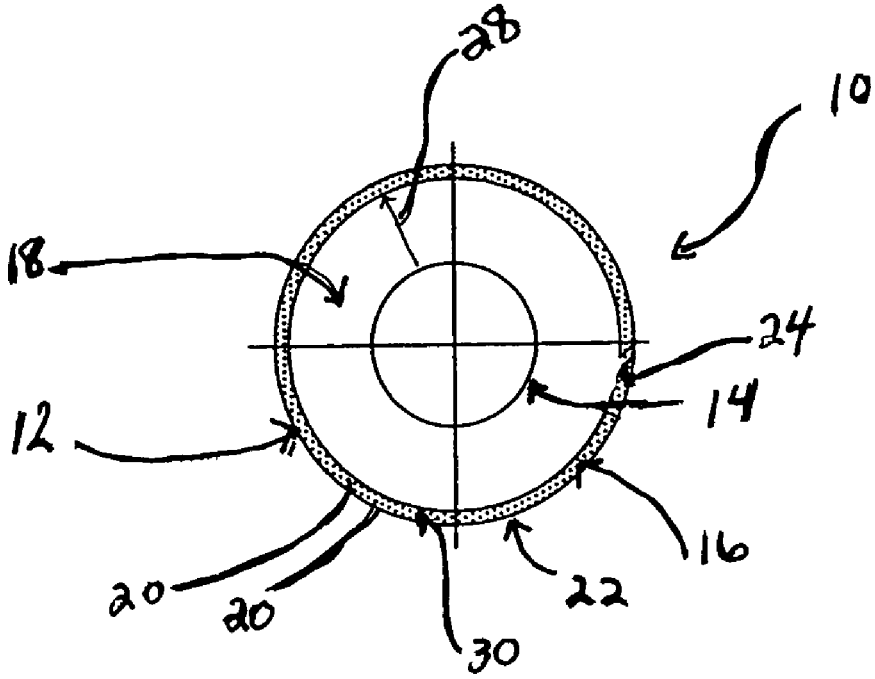
FIG. 1 illustrates a plan view of one embodiment of abrasive tool of the present invention.

This invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

The present invention relates to an abrasive tool having a porous region. The abrasive tool may have any shape suitable for a particular purpose, such as a wheel, a cup shaped wheel, and a disk. The porous region may be positioned at or near the working surface or edge of the abrasive tool. For example, the abrasive tool may be in the shape of a disk or wheel having a porous outer circumferential abrasive region that is suitable for cutting or grinding hard materials, such as metals, ceramics and composites comprising metals or ceramics. The outer circumferential abrasive region, as used herein, is defined as a margin extending from an outer circumference of the disk toward an inner hub of the wheel along a radius of the disk.

The porous outer circumferential abrasive region reduces wheel loading and the number of grinding points, and therefore the grinding force and power consumption, surprisingly without sacrificing the overall strength of the wheel or disk. The reduced number of cutting points also allows the use of higher concentrations of finer abrasive grains for improved surface finish as well as higher cut rates. As used herein, the phrase "wheel or disk loading" is defined as the accumulation of grinding debris on a grinding face of the abrasive tool, with resultant dulling of the tool.

The abrasive disks are preferred for cutting, slotting, slicing, dicing, or grinding semiconductor materials such as alumina titanium carbide (Al—TiC) wafers used in the manufacture of electronic components.

These abrasive disks have a monolithic construction (i.e., are not assembled with a hub or bushing) and they typically are mounted, either singly or as gangs, by means of a set of flanges onto a machine arbor. Optionally, spacer units are used between the flanges on a ganged set of disks. Sets of flanges of variable diameter may be used sequentially as the disk wears. When the abrasive disk diameter is at a maximum, larger diameter flanges offer extra mechanical support to the disk, while after significant wear, a reduced diameter disk may be mounted with smaller diameter flanges that expose more of the disk diameter for cutting or grinding use.

The disk may be formed of any material having sufficient strength for a selected purpose. For example, the material may be a metal, such as nickel, aluminum, iron, or steel. Suitable disk materials are described in U.S. Pat. No. 6,056,795 which discloses an abrasive wheel formed of a composition of nickel and tin with a stiffness enhancing metal component, preferably tungsten, molybdenum, rhenium, and combinations thereof, and is incorporated herein by reference for all purposes. Alternatively, the disk may be constructed of polymeric, ceramic or other materials, and may be a composite or laminate or combination of these materials The use of metal bonded disks as well as resin or glass bonded systems is considered to be within the scope of this invention. The disks include abrasive grain of the types known in the art, and may include a vibration dampening medium. In resin bonded tools, dampening media added to the bond may include relatively low elastic modulus polymers (i.e., relative to the elastic modulus of a phenolic resin), such as PVA, epoxy or polyimide polymers. In an alternative embodiment, the pores of a metal bonded abrasive disk may be filled with a polymeric material, such as a liquid epoxy, in order to dampen vibration of the disk during cutting. Within a metal bonded abrasive disk, materials such as manganese or cast iron may be added to nickel, tin, or other metals that are the principal components of the bond, in order to improve vibration dampening in the metal bonded tool. In a preferred embodiment, the disk includes an abrasive.

Abrasive disks may be dimensioned based upon a particular application, but for typical semiconductor processing application may generally have an outer diameter of approximately 125 mm (4.9 inch), an inner diameter of about 89 mm (3.9 inch), and a thickness of about 0.025 mm (0.001 inch) to about 0.625 mm (0.025 inch).

In one embodiment of the present invention shown in FIG. 1, disk 10 comprises an outer circumference 12, an intermediate circumference 24, an inner circumference 14, an outer porous abrasive region 16, and an inner circumferential region 18. The inner circumferential region extends circumferentially from the inner circumference 14 to the intermediate circumference 24 along a first partial radius ($r_1$) 28. The inner circumferential region may, but need not, comprise abrasive grains. The inner and outer regions may form a single continuous, porous abrasive region or they may be discrete regions. The inner circumferential region may be solid, substantially solid, or may be progressively more solid at locations moving along the radius of the disk toward the center of the disk. As used herein, the term "solid" is defined as being without any internal cavities extending to a surface of the abrasive region. In one embodiment, the inner circumferential region 18 is solid and extends to a diameter equal to the diameter of the smallest flanges used to mount the abrasive disk onto a machine arbor. Mechanical stresses are largest at the inner circumference of the abrasive disk and, thus, a solid inner region insures integrity of the abrasive disk during operation The thickness of the abrasive disk is not critical to stress tolerance in most abrasive disks of the invention, because the principal stress during operation of the disk is rotational stress. However, when the porous region of the disk is manufactured via an etching process, the dimension of the solid regions between pores must be at least as large as the thickness dimension of the disk in order to form the pores. Further, as the thickness of the disk is reduced, the number or volume percentage of pores must be reduced. If the pores do not extend through the thickness of the disk, more pores and a larger volume percentage of void area can be used effectively.

In one embodiment, the disk is configured to retain sufficient solid region to operate at standard operating speeds without failure. As used herein, the word "failure" is defined as breaking, cracking or chipping, making the disk unusable at a desired speed. In one embodiment, a metal bonded disk is configured to operate at a peripheral speed of 18,000 surface feet/minute (91 meters/second). In another embodiment, a resin bonded disk is configured to operate at a peripheral speed of 12,000 surface feet/minute (61 meters/second).

In one embodiment, the ratio of the average pore dimension to the average dimension of solid material separating one pore from another (the average "spacer wall dimension") generally is less than about 5:1. In another embodiment, the ratio of the average pore dimension to the average spacer wall dimension is less than about 4:1. In yet another embodiment, the ratio of the average pore dimension to the average spacer wall dimension is in the range of about 0.5:1 to about 3:1. Thicker disks can be made at the higher ratios of about 3:1 to about 5:1. If the ratio decreases too far below about 0.5:1, the number of cutting points increases to resemble that of a solid disk, causing the free cutting benefits of the invention to deteriorate.

In one embodiment, the outer porous region comprises about 50 volume % to about 95 volume % solid material (metal bonded abrasive grain) and about 5 volume % and about 50 volume % pores. In another embodiment, the outer porous region comprises about 50 volume % to about 80 volume % solid material (metal bonded abrasive grain) and about 20 volume % to about 50 volume % pores. In another embodiment, the outer porous region comprises about 50 volume % to about 75 volume percent of solid material. In yet another embodiment, the outer porous region comprises about 55 volume % to about 66 volume %.

The outer porous abrasive region 16 extends circumferentially from a radius of the intermediate circumference 24 to the outer circumference 12 along a second partial radius ($r_2$) 30. The outer circumferential abrasive region 16 has an average second partial radius ($r_{2\text{-}avg}$) measured by the average perpendicular distance between a tangent at the outer circumference of the disk and a tangent at the intermediate circumference.

A plurality of pores 20 that preferably extend through disk 10 from a first surface 22 to a second surface (not shown) are positioned in the outer circumferential abrasive region 16. As used herein, the term, pore is defined as a small interstice. The pores may, but need not, extend perpendicularly from a surface of the disk. The pores may also, but need not, extend entirely through the disk from a first surface to a second surface. In one embodiment, the pores extend entirely through the thickness of the disk, in a direction substantially perpendicular to the surface of the disk.

The cross-sectional area at each surface of the pore may be substantially similar. Alternatively, the cross-sectional areas of each pore may vary randomly or according to distance from a surface. For example, the cross sectional area at a distance midway between the first and second surfaces may be smaller than the cross-sectional area of the pore at one or both surfaces.

The pores may have any dimension and position relative to one another suitable for a particular purpose. Pores of different configurations may provide different cutting characteristics. For example, circular pores provide more surface contact to a workpiece being cut or ground, resulting in a variable cutting action, increasing forces and detracting from the overall freedom of cut. Linear, or non-circular pores, may be used to provide a consistent free cutting action.

The pores may have a polygonal cross-sectional shape such as square, rectangle, triangle and the like. In one embodiment, the pores are square or rectangular. In another embodiment, the pores are hexagonal. Other cross-sectional shapes, such as, circle, ellipse, pentagon, heptagon, octagon, decagon, and trapezoid, are all contemplated within the scope of this invention. The pores may also have a cross-sectional shape of any pre-selected irregular shape. The pores may vary in size and shape or be substantially similar to one another. The pores may be positioned relative to one another in a lattice pattern, in a predetermined pattern determined by the location in the outer circumferential abrasive region, or randomly placed. The pores may also be positioned in a SARD formation, that is a self-avoiding array design, where pores are randomly placed, but placement is controlled so that pores avoid contacting one another. Portions of pores may be positioned at the outer circumference effectively forming a jagged edge at the outer circumference.

In one embodiment, the overall pore pattern is selected to provide a relatively constant number of cutting points in the radial direction of the disk. As used herein, the phrase "overall pore pattern" is defined as the combination of pore shape(s) and size(s) as well as the placement of one pore relative to another. As used herein, "relatively constant number of cutting points" is defined as about a 5% or less variation in the number of active cutting points on the disk during disk use. The number of active cutting points may be matched to work material type, material removal rate, disk width, and the like. However, the selected overall pore pattern should not result in failure of the outer circumferential abrasive region, and more specifically breakage at the outer circumference, but should be configured to provide sufficient strength to grind a particular material without the disk breaking. For example, large square pores of about 500 microns by 500 microns (0.02 inch by 0.02 inch) separated by about 100 microns (0.004 inch) in a disk thickness of about 50 microns (0.002 inch) to about 500 microns (0.020 inch) may result in disk breakage at the outer circumference during use. In one embodiment, the pores are separated from one another by at least about 100 microns (0.004 inch). In another embodiment, the pores are separated from one another by at least a distance substantially equal to the thickness of the disk. In another embodiment, the pores within an abrasive region are separated from one another by a distance substantially equal to the thickness of the disk.

In one embodiment, the pores have a liner dimension of between and including about 0.002 inch (50 microns) and about one third of the second partial radius ($r_2$) and have a spacer wall dimension minimum of about 0.001 inch (25 microns)

In another embodiment, the overall pore pattern is selected to provide a substantially constant circumferential contact length between the disk and the workpiece. In another embodiment the overall pore pattern is selected to provide a substantially uniform disk wear factor. As used herein, the phrase "circumferential contact length" is defined as the outer circumferential edge of the disk excluding the pores, and the phrase "wear factor" is defined as the radial wear of the disks divided by the length of the workpiece sliced. The use of circular pores may result in a continually changing contact length, however, linear patterns encompassing straight sides may result in a more uniform contact length and therefore, more uniform radial wear. In a one embodiment, the pores have substantially linear polygonal cross-sectional shapes.

The outer circumferential abrasive region may have any average second partial radius ($r_{2\text{-}avg}$) suitable to provide a grinding surface for a particular purpose. Each second partial radius ($r_2$) within the average second partial radius may vary throughout the surface of the disk, or may preferably be substantially constant. That is, the radius of a particular point on the intermediate circumference may vary along the intermediate circumference of the disk and/or the radius of a particular point on the outer circumferential radius may vary along the outer circumference. A length of the second partial radius may be determined by the thickness of the particular workpiece, allowing a sufficient margin for wear. Because tangential stresses are highest at the inner diameter of the disk, it is desirable to limit the second partial radius to that portion of the disk that actively participates in grinding, although the present invention is not so limited. For example, a second partial radius of about 3 mm (0.19 inch) is suitable for slicing a 1 mm (0.04 inch) work-piece while allowing 2 mm (0.08 inch) for wear. In one embodiment the second partial radius is between about 1% and 30% of the total radius of the disk, and may typically be about 10% to about 20% of the total radius. In another embodiment, the second partial radius is less than or equal to about 10% of the total radius of the disk and preferably less than or equal to about 6% of the total radius of the disk.

Figure 2:
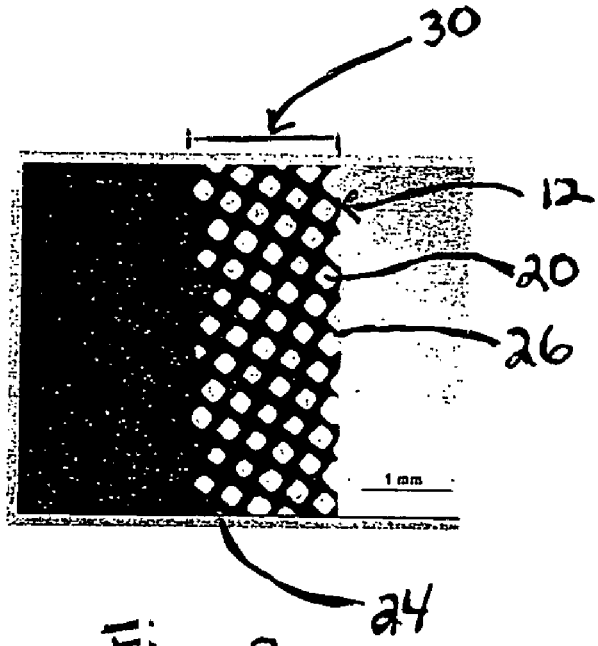
FIG. 2 illustrates an enlarged portion of the tool of FIG. 1 according to another aspect of the invention.

FIG. 2 illustrates an exploded view of a portion of the disk 10 of FIG. 1 in which the pores are square. The disk of FIG. 2 includes an outer circumferential abrasive region 16 and a solid inner circumferential region 18. Each of the pores 20 is substantially uniform in cross-sectional area, and the pores 20 are arranged in a regular pattern. In this embodiment, the outer circumference is interrupted by the presence of pore portions 26. In this embodiment, a plurality of squares, approximately 200 microns (7.9 inches) by 200 microns (7.9 inches), are separated from one another by a distance of approximately 100 microns (0.004 inch).

In one embodiment of the present invention, the pores 20 may be made in a preformed disk or ring formed or cut into a planar shape. The disk may be formed by any conventional method which forms a solid disk comprising an abrasive. Preferably, the disk is made by electroforming, but techniques such as electroplating, brazing, sintering, hot pressing, or hot coining may be used. Electrodeposition of metals to form an abrasive wheel or disk is known in the art. For example, U.S. Pat. No. 3,886,925 discloses a wheel with an abrasive layer formed of high purity nickel electrolytically deposited from nickel solutions having finely divided abrasive suspended in them. U.S. Pat. No. 4,180,048 discloses electrolytically depositing a thin layer of chromium on a previously formed nickel wheel. In a preferred embodiment, the disk is electroformed through the deposition of nickel and abrasive to form a metal matrix composite comprising abrasive grain as the discontinuous phase of the composite.

Any abrasive suitable to grind a particular workpiece may be used in the formation of the disk. The abrasive may be a conventional abrasive, a superabrasive, or combinations thereof. Examples of conventional abrasives include, but are not limited to, aluminum oxide, including fused aluminum oxide, heat treated aluminum oxide, white fused aluminum oxide, ceramic aluminum oxide such as sintered sol gel alumina, silicon carbide, mullite, silicon dioxide, alumina zirconia, cerium oxide, titanium carbide, tungsten carbide, boron carbide, titanium diboride, silicon nitride, garnet, and combinations thereof. Examples of superabrasives include, but are not limited to, cubic boron nitride (CBN), hexagonal boron nitride, diamond (natural and/or synthetic), and combinations thereof. The boron nitride and diamond abrasive grains may be polycrystalline or monocrystalline. The diamond abrasive particles may have a needle shape, a blocky shape or combinations thereof. In a pone embodiment, the abrasive is diamond supplied by Amplex Corporation (Oelephant, Pa.). In another embodiment, the abrasive is a blocky diamond.

The abrasive may contain a surface coating which will vary in nature, depending on the abrasive used. For example, fused alumina abrasive grains may be coated with iron oxide or silane, such as gamma porpyl triethoxy silane to enhance grinding quality. CBN or diamond abrasive grains may have a metal coating, such as nickel, aluminum, copper, or the like. Alternatively CBN or diamond grains may have an organic coating or an inorganic coating, such as silica.

The abrasive particles for cutting ceramic wafers may have any grit size suitable for a particular purpose. The abrasive grains are usually utilized in fine particle form. Generally, for slicing silicon wafers and alumina-titanium carbide pucks, the particle size of the grains will be in the range selected to reduce chipping the edges of the work piece. The abrasive particles may have a grit size ranging from about 1 micron to about 8 microns. In one embodiment, the abrasive grit size ranges from about 4 microns to about 8 microns. In another embodiment, the abrasive grit size ranges from about 3 microns to about 6 microns. In yet another embodiment, the abrasive grit size ranges from about 2 microns to about 4 microns. Depending upon the intended use for the tool, the abrasive grit size may range from submicron sizes to 40 microns (in largest average dimension of the grit).

Abrasive particles may be present in any concentration suitable for a particular purpose. In one embodiment, the concentration of abrasive is sufficient to impart appropriate strength and cutting surfaces to the disk. Abrasive concentrations may range from about 1 vol. % to about 45 vol. % of the total volume of the outer circumferential abrasive region. Abrasive concentrations are typically over 15 vol. %. In a preferred embodiment, the concentration of abrasive is about 37 vol. % (or about "150 concentration"). Abrasive grain concentration may range from about 2 to about 50 vol. % of the solids content of the outer circumferential abrasive region, preferably about 10 to about 50 vol %.

The pores of the present invention may be formed in the disk by any process able to provide a predetermined cross-sectional shape, cross-sectional size, and relative pore placement. Examples of processes suitable for pore formation include, but are not limited to, etching, laser assisted machining, water jet cutting, ion beam milling, and shot peening. Alternatively, the pores in the outer circumferential abrasive region may be formed simultaneously during formation of the disk, for example, by molding.

The use of a preformed mask during etching provides pore consistency both within the disk and from disk to disk. In a one embodiment, the pores may photo-chemically etched using well know photochemical etching techniques, such as those use in semiconductor processing. For example, a mask may be applied to each surface of a disk, wherein the mask has a plurality of apertures exposing regions of the disk. Abrasive may be removed from the exposed regions of the disk forming a porous region. Alternatively, a photoresist may be applied to each surface of the disk, and a photo tool, or mask, may be applied to the disk over the photoresist. Upon exposure to a light source, such as ultraviolet light, the areas exposed to the light source cures becoming resistant to an etchant. Regions of the disk not exposed to the light source having uncured photoresist may then be removed forming a porous region of the disk.

EXAMPLES

The invention may be further understood with reference to the following examples, which are intended to serve as illustration only, and not as a limitation of the present invention as defined in the claims herein.

Samples for the following examples were made by modifying electro-formed disks. The disks were prepared through the deposition of nickel and diamond abrasives, which were then stripped and finished to an outside diameter of about 110 mm (4.3 inches), an inside diameter of about 89 mm (3.5 inches), and a thickness of about 0.112 mm (0.0044 inch) to form a solid disk. Each disk formed comprised a diamond abrasive concentration of about 37.5 vol. %.

A portion of the solid disks were subsequently etched with Ferric Chloride to produce a pore modified disks. In pore modified disks, square pores were photochemically etched in the outer region of the disk in a uniform pattern. The average second partial radius (for example, $r_{2\text{-}avg}$ in FIG. 1) extended between the outside diameter of the disk and a diameter of about a 107.08 mm (4.2 inches) at the intermediate circumferential region 24 of the disk. The average second partial radius was essentially uniform in length.

The etching process comprised applying a photoresist to each side of the disk. A photo tool, with the desired pattern of pores, is then positioned on each side of the disk, which is then exposed to a light source causing the photoresist to cure in the desired pattern. The disk is then etched with hot acid at about 125° F. to remove that portion of the disk under the uncured photoresist, forming pore modified disks. Electroformed disks that were not modified with pores were retained as solid controls.

The disks were tested on an Al—TiC wafer as available from Neomax America, Inc. (Santa Clara, Calif.). A 114 mm (4.5 inches) by 114 mm (4.5 inches) square of Al—TiC having a thickness of 4.8 mm (0.19 inch) was sliced in half. The pore modified disk was tested on one half, and the solid disk was tested on the other half. Slices were made at a work speed of 25, 51, 76, 102 mm per minute (1, 2, 3, and 4 inches per minute) and a disk speed of 10,000 rpm. Each piece was subsequently cleaned with acetone and evaluated with a WYCO optical profiler (Veeco Instruments, Inc. Woodbury, N.Y.). Edge quality was measured at the work speeds of 51, 76, 102 mm per minute (2, 3, and 4 inches per minute) before and after cutting 20 slices through the wafer at a cut depth of 1 mm (0.039 inch) and a length of 57 mm (2.25 inches). Due to limitations of the optical profiler, surface profiles of Al—TiC had a minimum measurement of 2.5 nanometers ($9.84\times10^{-8}$ inch).

Example I

Two disks having a blocky diamond abrasive grit size of 4-8 microns were prepared, one of which was modified with pores, the other of which was used as a solid control. Square pores, 200 microns (0.0079 inch) by 200 microns (0.0079 inch) separated by 100 microns (0.004 inch), were formed in the outer circumferential abrasive region of the modified disk. Table 1 shows the surface finish of the pore modified disk compared to the corresponding solid disk having the same disk material composition. Surface finish readings (Ra) were taken after the $1^{st}$ slice, after the $10^{th}$ slice, and after the $20^{th}$ slice and the results are shown in Table I. Ra readings are reported in nanometers.

TABLE I

| Table Speed Inches/min (mm/min) | Disk Design | $1^{st}$ Ra nm | $10^{th}$ Ra nm | $20^{th}$ Ra nm | Average Ra nm |
|---|---|---|---|---|---|
| 2 (51) | Solid | 7.2 | 8.2 | 10.0 | 8.47 |
| 2 (51) | Pore | 7.03 | 4.8 | 7.57 | 6.47 |
| 3 (76) | Solid | 5.50 | 5.40 | 13.7 | 8.2 |
| 3 (76) | Pore | 5.35 | 8.84 | 8.39 | 7.53 |
| 4 (102) | Solid | 6.80 | 6.30 | 5.60 | 6.23 |
| 4 (102) | Pore | 6.21 | 6.16 | 7.28 | 6.55 |

As noted in Table I, the pore modified disk resulted in a 23.62% improvement in the average surface reading over the solid disk at a table speed of 2 inches per minute (51 mm/min.), and a 8.21% improvement at a table speed of 3 inches per minute (76 mm/min.). However, at a table speed of 4 inches per minute (102 mm/min.), the pore modified disk showed a 5.08% loss in the average surface quality compared to the solid disk. The pore modified disk containing abrasive grains of about 4-8 microns exhibited a marked increase in surface finish quality at table speeds of 2 and 3 in./min. (51 and 76 mm/min.), while only a slight decrease in surface finish quality at a table speed of 4 in./min (102 mm/min.).

Example II

Two disks having a blocky diamond abrasive grit size of 3-6 microns were prepared, one of which was modified with pores, the other of which was used as a solid control. Square pores, 200 microns (0.0079 inches) by 200 microns (0.0079 inches) separated by 100 microns (0.004 inches), were formed in the outer circumferential abrasive region of the modified disk. Table II shows the surface finish of the pore modified disk compared to the corresponding solid disk having the same disk material composition. Surface finish readings (Ra) were taken after the $1^{st}$ slice, after the $10^{th}$ slice, and after the $20^{th}$ slice and are reported in Table II. Ra readings are reported in nanometers.

TABLE II

| Table Speed Inches/min. (mm/min.) | Disk Design | $1^{st}$ Ra nm | $10^{th}$ Ra nm | $20^{th}$ Ra nm | Average Ra nm |
|---|---|---|---|---|---|
| 2 (51) | Solid | 12.14 | 9.69 | 10.11 | 10.65 |
| 2 (51) | Pore | 4.62 | 3.32 | 6.98 | 4.97 |
| 3 (76) | Solid | 7.25 | 5.86 | 10.48 | 7.86 |
| 3 (76) | Pore | 4.52 | 4.80 | 4.73 | 4.68 |
| 4 (102) | Solid | 5.81 | 6.50 | 5.39 | 5.90 |
| 4 (102) | Pore | 5.18 | 4.81 | 4.98 | 4.99 |

The presence of a porous outer circumferential abrasive region significantly improves the surface finish of the workpiece. As noted in Table II, the pore modified disk resulted in a 53.29% gain in the average surface reading over the solid disk at a table speed of 2 inches per minute (51 mm/min.), a 40.44% gain at a table speed of 3 inches per minute (76 mm/min.), and a 15.42% gain at a table speed of 4 inches per minute (102 mm/min.). The pore modified disk containing abrasive grains of about 3-6 microns exhibited a significant increase in surface finish quality at all reported table speeds.

It is also noted from Table II that the pore modified disk operating at a table speed of 4 in/min. (102 mm/min) provides a better surface finish than the solid disk at any table speed. The pore modified disk is, therefore, able to operate at faster speed than the solid disk, and still achieve a desired surface finish.

Moreover, there is a significant improvement in surface finish quality when using the pore modified disk with the finer abrasive grit of 3-6 microns compared to the pore modified disk with the abrasive grit of 4-8 microns for all of the reported speeds. In a comparison of the average surface reading in Tables I and II, at a table speed of 2 in/min. (51 mm/min.), surface finish quality increases by 23.2% by reducing the abrasive grit size from 4-8 microns to 3-6 microns. Similarly, the average surface reading at 3 in/min. and 4 in/min. (76 and 102 mm/min) increases by 37.8% and 23.8%, respectively, by reducing the abrasive grit size from 4-8 microns to 3-6 microns.

In contrast to the superior performance of the pore modified disk at a finer grit size, the solid disk shows a significant negative impact on surface finish quality at 2 in/min. (51 mm/min.), and only a slight positive impact at 3 in/min. and 4 in/min. (76 and 102 mm/min.) when the abrasive grit size is reduced from 4-8 microns to 3-6 microns. Again, when comparing the data of Tables I and II, it is shown that at a speed of 2 in/min. (51 mm/min.), reducing the grit size in the solid disk greatly reduces the surface finish quality by 25.7%, and only slightly improves the surface finish quality by 4.1% and 5.3%, for 3 in/min. and 4 in/min. (102 mm/min.) respectively, when reducing the grain size from 4-8 microns to 3-6 microns.

As the data shows, the presence of pores in the outer periphery of the disk reduces the grinding forces compared to the grinding forces of the solid disk, and therefore creates less disk deflection, less disk loading, and therefore provides a smother finish at higher cut rates. Moreover, because the disks performed at least as well as or better than the solid disks, it is presumed that the overall strength of the pore modified disk was not adversely impacted.

Example III

Nickel pore modified disks having a blocky diamond concentration of 37.5 vol. % were prepared. The disks had an outer diameter of 101 mm (4 inches), and inner diameter of 88 mm (3.5 inches) and a thickness of 0.120 mm (0.004 inch). The diamond abrasive had a grain size of 4-8 microns. Square pores having a dimension of 200 microns by 200 microns (0.0070 inch by 0.0079 inch) were etched into the outer circumferential abrasive region in a regular pattern spaced about 100 microns (4 inches) apart. The disks were used to slice Al—TiC read-write heads having a thickness of 300 microns (0.012 inch). The disks were tested at 8,000 rpm and 10,000 rpm at table speeds of 1-6 inches per minute (25-152 mm/min.). The sliced parts had an average surface finish of 6 nanometers Ra, falling within mirror surface finish reading of less than 8 nm Ra.

Again the porous modified abrasive disks produce a suitable surface finish even at speeds of up to 6 in/min (152 mm/min.). An increase in table speed from 4 in/min. to 6 in./min. (102 to 152 mm/min.) represents a 33% increase in speed, and productivity.

Example IV

A pore modified disk (4.3 in.×0.0044 in.×3.401 in.) (110 mm×112 μm×89 mm) having a blocky diamond abrasive grit size of 3-6 microns and a pore modified disk having a blocky diamond abrasive grit size of 4-8 microns were prepared. Square pores having a dimension of 500 microns by 500 microns (0.02 inch by 0.02 inch) separated by 100 microns (0.004 inch) were positioned in the outer circumferential abrasive region of the disk. During grinding trials, these disks broke repeatedly at the outer diameter, and therefore, were not useable. Thus, a disk having a pore to spacer wall ratio of 5:1 lacked sufficient mechanical strength to cut ceramic material.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the scope of the invention. Accordingly, the foregoing description and drawings are by way of example only.

The invention claimed is:

1. An abrasive disk comprising:

a body containing an abrasive;

a continuous region adjacent an inner circumference of the disk; and a porous region comprising a plurality of pores having polygonal cross-sectional shapes, the porous region adjacent an outer circumference of the disk, wherein:

the plurality of pores is arranged in a lattice such that the plurality of pores form a periodic pattern:

about 50 volume % to about 80 volume % of the porous region comprises metal bonded abrasive grain;

the plurality of pores are configured and arranged to provide a relatively constant wear factor; and portions of the pores are positioned at the outer circumference, said portions being open at the outer circumference thereby forming a jagged edge.

2. The abrasive disk of claim 1, wherein the body is a disk.

3. The abrasive disk of claim 2, wherein the porous region comprises a plurality of pores extending in a substantially perpendicular direction from a first surface of the disk to a second surface of the disk.

4. The abrasive disk of claim 3, wherein the plurality of pores comprise substantially similar cross-sectional areas and substantially similar cross-sectional shapes.

5. An abrasive disk comprising:

a body containing an abrasive;

a continuous region adjacent an inner circumference of the disk; and a porous region comprising a plurality of pores, wherein the pores are in a position relative to one another in a lattice pattern or are in a periodic array pattern determined by the location in the outer circumferential abrasive region, the porous region adjacent an outer circumference of the disk, wherein about 50 volume % to about 80 volume % of the porous region comprises metal bonded abrasive grain, and wherein the plurality of pores are configured and arranged to provide a relatively constant wear factor.

6. The abrasive disk of claim 5, wherein the plurality of pores have polygonal cross-sectional shapes.

7. The abrasive disk of claim 6, wherein the polygonal cross-sectional shapes are selected from the group consisting of: square, rectangle, triangle, diamond, pentagon, hexagon, and combinations thereof.

8. An abrasive disk comprising:

a body containing an abrasive, wherein the body is a disk;

a continuous region adjacent an inner circumference of the disk; and a porous region comprising a plurality of pores extending in a substantially perpendicular direction from a first surface of the disk to a second surface of the disk, the porous region adjacent an outer circumference of the disk, wherein:

about 50 volume % to about 80 volume % of the porous region comprises metal bonded abrasive grain, wherein the plurality of pores are configured and arranged to provide a relatively constant wear factor;

portions of the pores are positioned at the outer circumference, said portions being open at the outer circumference thereby forming a jagged edge; and pores within the plurality of pores have a cross-sectional area at the first surface greater than a cross-sectional area at a point between the first surface and the second surface.

9. The abrasive disk of claim 4, wherein the cross-sectional shapes are squares.

10. The abrasive disk of claim 4, wherein the cross-sectional shapes are diamonds.

11. The abrasive disk of claim 1, wherein the continuous region has a first partial radius greater than or equal to about 10% of the radius of the disk.

12. The abrasive disk of claim 1, wherein the porous region comprises a second partial radius of less than or equal to about 10% of a radius of the disk.

13. The abrasive disk of claim 12, wherein the second partial radius is less than or equal to about 6% of the radius of the disk.

14. The abrasive disk of claim 13, wherein the second partial radius is less than or equal to about 5% of the radius of the disk.

15. The abrasive disk of claim 1, wherein the pores have a maximum dimension substantially equal to a thickness of the disk at the outer circumference.

16. The abrasive disk of claim 9, wherein the square is about 200 microns$^2$.

17. The abrasive disk of claim 3, wherein the plurality of pores are separated from one another by a distance substantially equal to a thickness of the abrasive disk at the outer circumference.

18. The abrasive disk of claim 1, wherein the polygonal cross-sectional shapes are selected from the group consisting of: square, rectangle, triangle, diamond, pentagon, hexagon, and combinations thereof.

19. The abrasive disk of claim 1, wherein the abrasive is selected from the group consisting of: diamond, CBN, and combinations thereof.

20. An abrasive disk comprising:

a body containing an abrasive;

a continuous region adjacent an inner circumference of the disk;

a porous region adjacent an outer circumference of the disk, wherein about 50 volume % to about 80 volume % of the porous region comprises metal bonded abrasive grain; and a bond includes a vibration dampening medium comprising a polymer having a lower elastic modulus as compared to a phenolic resin bond material.

21. The abrasive disk of claim 20, wherein the polymer includes an epoxy.

22. The abrasive disk of claim 20, wherein the polymer includes a material selected from the group consisting of: a polyvinyl acetate, a polyimide, and combinations thereof.

23. The abrasive disk of claim 1, wherein the plurality of pores comprises linear cross-sectional shapes in the form of a linear polygon.

24. The abrasive disk of claim 1, wherein the abrasive disk has an outer circumference, the abrasive disk further having an outer peripheral edge extending along the outer circumference, pores of the plurality of pores extending to and terminating along the outer peripheral edge such that the pores are open along the outer peripheral edge.

25. The abrasive disk of claim 1, wherein the body is constructed and arranged to operate at a speed of about 12,000 surface feet/min or greater without failure.

26. The abrasive disk of claim 25, wherein the body is constructed and arranged to operate at a speed of about 18,000 surface feet/min or greater without failure.

* * * * *